US009974420B2

(12) United States Patent
Dietz et al.

(10) Patent No.: US 9,974,420 B2
(45) Date of Patent: May 22, 2018

(54) WINDOW WIPER

(71) Applicant: Carl Freudenberg KG, Weinheim (DE)

(72) Inventors: Markus Dietz, Erbes-Buedesheim (DE); Karl-Ludwig Gibis, Limburgerhof (DE); Ralf Juergens, Laudenbach (DE)

(73) Assignee: Carl Freudenberg KG, Weinheim (DE)

( * ) Notice: Subject to any disclaimer, the term of this patent is extended or adjusted under 35 U.S.C. 154(b) by 0 days. days.

(21) Appl. No.: 15/115,697

(22) PCT Filed: Jan. 27, 2015

(86) PCT No.: PCT/EP2015/051562
§ 371 (c)(1),
(2) Date: Aug. 1, 2016

(87) PCT Pub. No.: WO2015/113952
PCT Pub. Date: Aug. 6, 2015

(65) Prior Publication Data

US 2017/0164798 A1 Jun. 15, 2017

(30) Foreign Application Priority Data

Feb. 3, 2014 (DE) ..... 10 2014 001 250

(51) Int. Cl.
*A47L 1/06* (2006.01)
*A47L 7/00* (2006.01)

(52) U.S. Cl.
CPC ..... *A47L 1/06* (2013.01); *A47L 7/0009* (2013.01); *A47L 7/0023* (2013.01)

(58) Field of Classification Search
CPC ..... A47L 1/06; A47L 7/0009; A47L 7/0023; A47L 13/11; A47L 13/08; A46B 5/0075; A46B 5/0083; A46B 7/04; A46B 5/0095
See application file for complete search history.

(56) References Cited

U.S. PATENT DOCUMENTS 731,338 A 6/1903 Cattelle
3,766,591 A * 10/1973 Soito ..... A47L 13/11 15/244.1

(Continued)

FOREIGN PATENT DOCUMENTS

CH 681209 A5 2/1993
DE 2555648 A1 6/1977

(Continued)

OTHER PUBLICATIONS

Kärcher Home & Garden, E6, Akku-Fenstersauger, Dec. 2010, pp. 96-98.

*Primary Examiner* — Dung Van Nguyen
(74) *Attorney, Agent, or Firm* — Leydig, Voit & Mayer, Ltd.

(57) ABSTRACT

A window wiper is substantially tee-shaped, having a wiper head and a wiper handle, the wiper head being bent with respect to the wiper handle and the wiper head and the wiper handle delimiting a bending angle. The wiper head and the wiper handle may be connected to each other by a flexible joint, the wiper head and the wiper handle being movable from an initial bending angle to a maximum final bending angle against the spring force of the flexible joint.

15 Claims, 4 Drawing Sheets

(56) References Cited

U.S. PATENT DOCUMENTS

| | | | | |
|---|---|---|---|---|
| 5,539,949 | A | 7/1996 | Stanton | |
| 6,931,690 | B2 * | 8/2005 | Cox | A47L 1/06 15/144.1 |
| 7,748,074 | B2 * | 7/2010 | Guizzi | A47L 1/06 15/152 |
| 8,544,146 | B2 | 10/2013 | Curien | |
| 9,021,654 | B2 * | 5/2015 | Fischer | A47L 1/05 15/320 |
| 2004/0226125 | A1 | 11/2004 | Cox | |
| 2011/0138554 | A1 | 6/2011 | Curien | |
| 2015/0208886 | A1 | 7/2015 | Fischer | |

FOREIGN PATENT DOCUMENTS

| | | | |
|---|---|---|---|
| DE | 102011050697 | A1 | 11/2012 |
| EP | 2230980 | B1 | 9/2010 |
| WO | WO 2004103141 | A1 | 12/2004 |
| WO | WO 2014009672 | A1 | 1/2014 |
| WO | WO 2014184514 | A1 | 11/2014 |

* cited by examiner

WINDOW WIPER

CROSS-REFERENCE TO RELATED APPLICATIONS

This application is a U.S. national stage application under 35 U.S.C. § 371 of International Application No. PCT/EP2015/051562, filed on Jan. 27, 2015, and claims benefit to German Patent Application No. DE 10 2014 001 250.6, filed on Feb. 3, 2014. The International Application was published in German on Aug. 6, 2015, as WO 2015/113952 A1 under PCT Article 21(2).

FIELD

The invention relates to a window wiper.

BACKGROUND

Window wipers of this type are generally known. The wiper head is provided with a squeegee lip consisting of a flexible rubber material, said squeegee lip extending parallel to the window to be wiped during the intended use of the window wiper.

Window wipers are known from the prior art in which the offset angle between the wiper head and the wiper handle is always constant during the intended use of the window wiper, i.e. it cannot be changed Other window wipers are also known from the prior art in which the wiper head and the wiper handle are interconnected by a hinge-like joint. This hinge-like joint can be locked by a separately produced clamping device which acts on the joint. The clamping device can be formed by a screw or nut, for example.

The offset angle can be adapted to the circumstances of the case of use before the actual wiping procedure. During the wiping procedure, it is impossible in practice to change the offset angle; said offset angle is constant during the wiping procedure.

SUMMARY

An aspect of the invention provides a window wiper which is substantially T-shaped, the wiper comprising: a wiper head; and a wiper handle, wherein the wiper head is arranged offset relative to the wiper handle, wherein the wiper head and the wiper handle define an offset angle, wherein the wiper head and the wiper handle are interconnected by a flexible joint, and wherein the wiper head and the wiper handle are configured to be movable from an initial offset angle into a maximum final offset angle against the spring force of a flexible joint.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
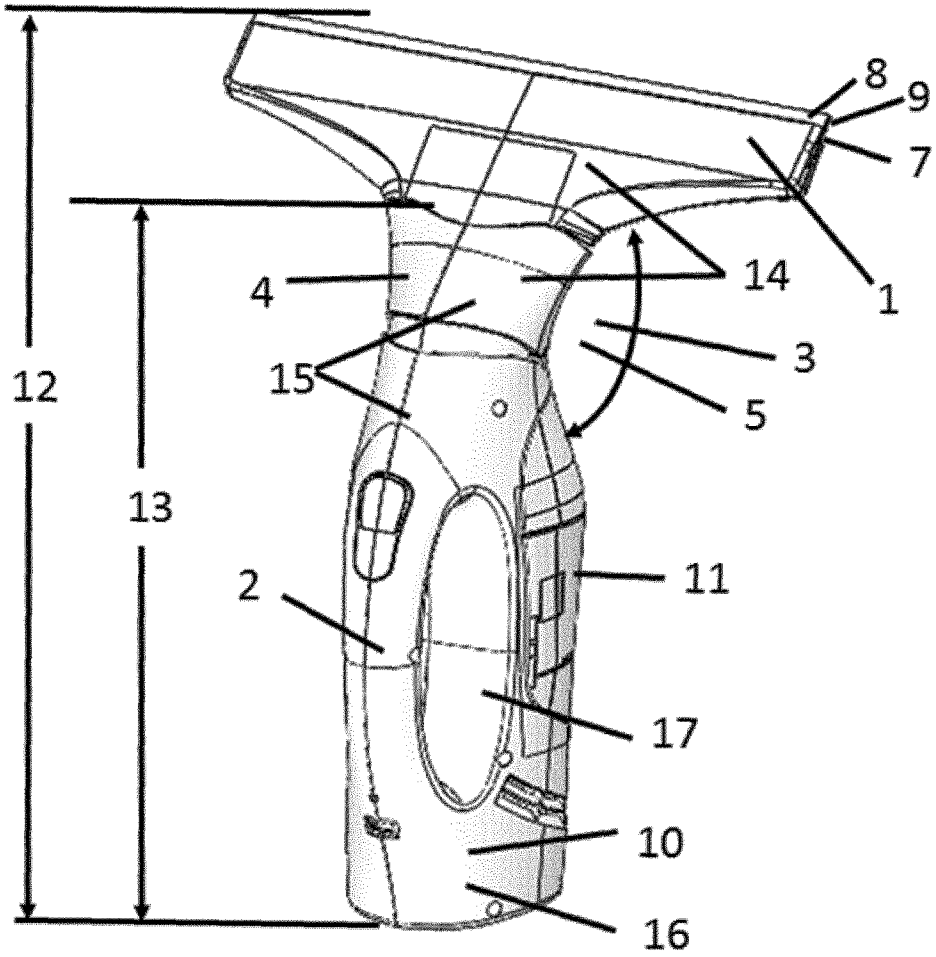
FIG. 1 is a perspective view of a window wiper, the wiper head and the wiper handle defining the initial offset angle.

An aspect of the invention relates to a window wiper which is substantially T-shaped and comprises a wiper head and a wiper handle, the wiper head being arranged offset relative to the wiper handle and the wiper head and the wiper handle defining an offset angle.

An aspect of the invention is to develop a window wiper of the type mentioned at the outset such that the lower region of windows can be easily cleaned even if a windowsill is situated under the window and/or even if the handle of the window wiper is very long, without the relative association of the wiper head with the window, in particular the angle of the squeegee lip to the window substantially changing. Furthermore, the window wiper should be easy to handle during its intended use and should be simple and economical to produce.

To achieve an object of the invention, it is provided that the wiper head and the wiper handle are interconnected by a flexible joint and that the wiper head and the wiper handle can be moved from an initial offset angle into a maximum final offset angle against the spring force of the flexible joint.

Due to the flexible joint which interconnects the wiper head and the wiper handle in a resiliently flexible manner, the lower region of windows can be easily cleaned even if a windowsill is situated under the window and/or even if the window wiper has a relatively long handle. Within the meaning of the invention, a "relatively long wiper handle" is understood as meaning wiper handles from approximately 20 cm in length.

To achieve a thorough cleaning of windows and in order to remove the cleaning liquid as far as possible without any smears, it is important that the squeegee lip of the wiper head is associated as unvaryingly as possible with the window during the entire wipe-off procedure, in particular that the angle at which the squeegee lip is guided over the window remains substantially constant.

In the case of conventional window wipers in which, although the wiper head and the wiper handle are interconnected offset from one another, they are interconnected rigidly, this angle which is favorable for a good wiping result can no longer be maintained particularly when the window wiper is used in the lower region of the window, specifically when a windowsill is situated under the window. If the favorable angle between the wiper head and the window were to be maintained in the lower region of the window as well, the wiper handle would strike against the windowsill and it would be impossible to move it any further downwards even if the lower region of the window had still not been wiped.

To clean the entire window, it is important mainly for this reason that the wiper handle can be moved past the windowsill without the angle at which the squeegee lip of the wiper head contacts the window substantially changing. The flexible joint is provided for this purpose.

Just before the wiper handle contacts the windowsill, the offset angle can be increased up to a maximum final offset angle so that the shape of the window wiper which is then straighter makes it possible for the window to be wiped down to its lower edge without the wiper handle contacting the windowsill and without the angle between squeegee lip and window changing in a disadvantageous manner.

The offset angle denotes the angle between the main axis of the squeegee lip and the main axis of the wiper handle.

The offset angle can preferably be changed progressively from an initial offset angle to the maximum final offset angle against the spring force of the flexible joint.

The handling of the window wiper according to the invention is extremely simple. Since the offset angle can be changed against the spring force of the flexible joint, the offset angle is optimally adapted during the wiping procedure in an automatic and independent manner. A separately performed adjustment of the offset angle is therefore not required. This is a very significant advantage.

The initial offset angle preferably corresponds to the minimum offset angle between wiper head and wiper handle. An embodiment of this type makes the handling of the window wiper simple and obvious. The window wiper is placed against the top of the window to be wiped in its initial offset angle and is then moved downwards. During the downwards movement of the window wiper on the window, the position of the wiper head relative to the window can be maintained substantially constant, even if the wiper handle is moved for the user's convenience in the direction of the final offset angle and, if appropriate, is moved past the windowsill under the window. As soon as the window wiper is lifted up from the bottom of the window by the user, the wiper head and wiper handle move back into their starting position at the minimum offset angle, i.e. at the initial offset angle. The initial offset angle is automatically adjusted merely by the flexible joint itself, without any intervention by the user.

The maximum final offset angle can be 120° to 175° and the initial offset angle can be 95° to 150°, the initial offset angle always being less than the final offset angle. The mentioned angles depend on the respective case of use, for example on the height of the window to be wiped and/or on the overall length of the window wiper, in particular on the length of the wiper handle. The aforementioned angles have proved to be advantageous for most cases of domestic use.

On its side remote from the wiper handle, the wiper head can have at least one squeegee lip, said squeegee lip preferably consisting of a flexible rubber material. Squeegee lips of this type have proved to be successful for removing cleaning liquid from windows. On the one hand, the cleaning liquid is removed from the window without leaving substantially any residue, and on the other hand the material protects the surface of the window panes.

The wiper head can have two squeegee lips which are adjacently associated with one another in a spacing and which extend parallel to one another. The squeegee lips are arranged in a functional series connection.

The claimed window wiper is particularly advantageous when it is configured as a window suction device. In this respect, the window wiper comprises a wiper head with a suction nozzle, a suction device and a dirty water tank being arranged in the wiper handle. The suction device can be formed, for example, by a suction pump which conveys the cleaning liquid from the window through the suction nozzle into the dirty water tank. Since the suction device and the dirty water tank, which respectively require adequate room to be able to apply the suction power and to receive the dirty water, are arranged inside the wiper handle, the window wiper inevitably cannot be of such a compact configuration as simple window wipers which do not have a suction device or a dirty water tank. Therefore, in the case of window suction devices it is particularly expedient to provide a flexible joint between the wiper head and the wiper head in order to be able to move the voluminous wiper handle of the suction wiper past the windowsill when the lower region of the windows is being wiped.

When the window wiper is configured as a window suction device, the front squeegee lip in the wiping direction can be configured as a sealing lip and can define, with the rear squeegee lip in the wiping direction, a storage space, the storage space being connected in a flow-conveying manner to the suction device.

The following is stated with regard to operation:

For wiping a window, the window wiper configured as a suction wiper is moved from the top to the bottom along the surface to be wiped. The cleaning liquid which is on the window and is to be wiped off accumulates by contact with the front sealing lip in the wiping direction, the accumulated cleaning liquid passing into the storage space through openings in the sealing lip. The openings can be semicircular and can run into the sealing edge of the sealing lip.

The storage space is defined by the front sealing lip and by the rear squeegee lip. Since the suction nozzle is connected in a flow-conveying manner to the storage space, the cleaning liquid in the storage space is conveyed through the suction nozzle into the dirty water tank and is retained therein.

The ratio of the overall length of the window wiper in cm to the maximum final offset angle in degrees is preferably 0.2 to 0.4. Such a ratio has proved advantageous in practice. For example, if a window wiper is used which has an overall length of approximately 40 cm, the offset angle is approximately within the aforementioned range.

The longer the wiper handle, the more important it is for the final offset angle to be as great as possible in order to avoid the situation in which the wiper handle rests on the windowsill under the window while the window is swept over from top to bottom, before the lower region of the window is also wiped.

Window wipers which are usually used for domestic purposes preferably have a minimum overall length of 30 cm and in such a case, the wiper handle has a minimum length of 20 cm. Due to the aforementioned dimensions, the window wiper is compact enough to be adequately manageable in usual cases of domestic use. A suction pump with a satisfactory suction power as well as a dirty water tank, the volume of which is enough for at least one window to be wiped in a working cycle, can be easily accommodated in a window wiper/window handle having the aforementioned dimensions.

The wiper head and/or the wiper handle and/or the joint can consist of a polymeric material. Polymeric materials are particularly advantageous in connection with window wipers. A window wiper of this type is corrosion-resistant and easy to handle on account of its low weight.

The wiper head and the joint or the wiper handle and the joint can be respectively configured as a unit which can be pre-assembled. It is easy to assemble a window wiper of this type and the risk of assembly errors is restricted to a minimum. The wiper head and the joint are preferably combined into a unit which can be pre-assembled. In the case of a window suction device, the waste water tank in the wiper handle is particularly easily accessible.

On its side remote from the wiper head, the wiper handle can have a substantially flat standing surface which merges into the underside of the wiper handle in an arcuately rounded or beveled manner. An embodiment of this type also effectively contributes towards the achievement of the object. Due to the arcuately rounded or beveled merging of the standing surface into the underside of the wiper handle, the wiper handle can be maneuvered particularly effectively past the windowsill under the window to be wiped, so that due to a merging of this type in conjunction with the flexible joint and a particularly great final offset angle, excellent use characteristics even of a long window wiper are provided.

Figure 2:
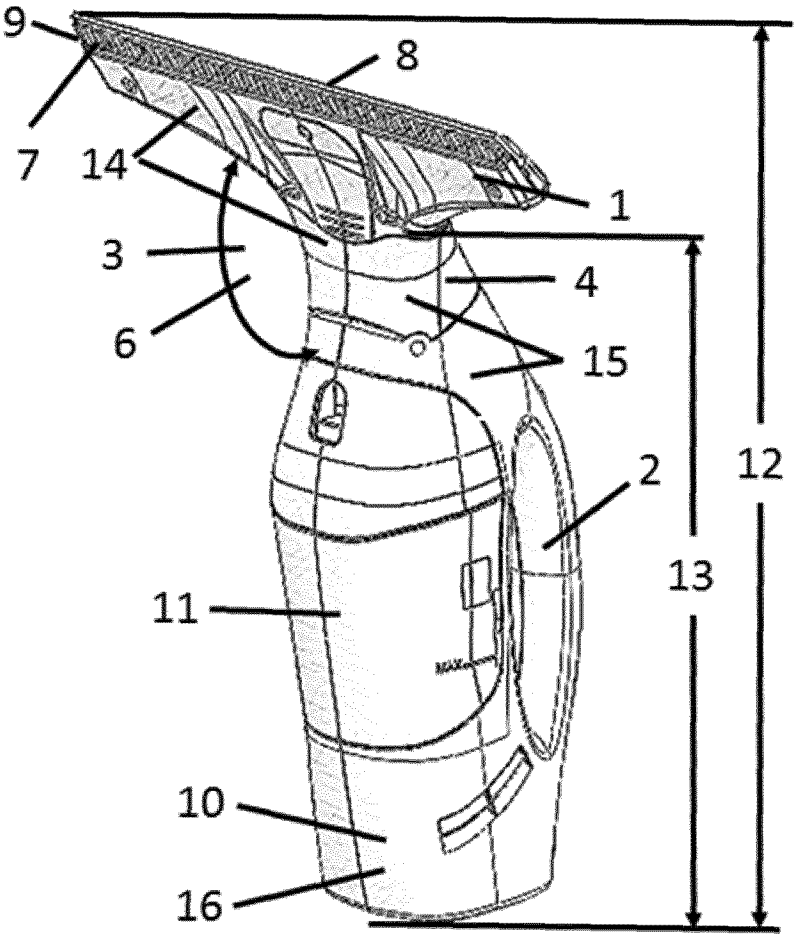
FIG. 2 shows the window wiper from FIG. 1, the maximum final offset angle between the wiper head and the wiper handle being shown.

FIGS. 1 and 2 show an embodiment of a window wiper according to the invention, the window wiper being configured as a window suction device.

The window wiper is substantially T-shaped and comprises a wiper head 1 and a wiper handle 2. On its side remote from the wiper handle 2, the wiper head 1 has two squeegee lips 7, 8 which extend substantially over the entire width of the wiper head 1 and consist of a flexible rubber material. The wiper head 1 and the squeegee lips 7, 8 extend parallel to an imaginary plane which corresponds to the window surface to be wiped.

The wiper head 1 is offset relative to the wiper handle 2, the wiper head 1 and the wiper handle 2 defining an offset angle 3. The wiper head 1 and the wiper handle 2 are interconnected by a flexible joint 4. The flexible joint 4 means that the wiper head 1 and the wiper handle 2 can be moved relative to one another from an initial offset angle 5 into a maximum final offset angle 6 against the spring force of the flexible joint 4.

In the embodiment shown, the wiper head 1 comprises the suction nozzle 9, a suction device 10 in the form of a suction pump and a dirty water tank 11 for receiving the cleaning liquid removed from the window pane being arranged inside the wiper handle 2.

The storage space 18 is defined by the front sealing lip 7 and by the rear squeegee lip 8. Since the suction nozzle 9 is connected in a flow-conveying manner to the storage space 18, the cleaning liquid in the storage space 18 is conveyed through the suction nozzle 9 into the dirty water tank 11 and is retained therein.

In the embodiment shown here, the ratio of the overall length 12 of the window wiper to the maximum final offset angle 6 is approximately 0.25, the overall length 12 of the window wiper being stated in cm and the maximum final offset angle 6 being stated in degrees. Specifically, the overall length 12 of the window wiper in the embodiment shown is approximately 35 cm, approximately 30 cm of which are apportioned to the length 13 of the wiper handle 2.

Such dimensions produce a compact, easy-to-handle window wiper which has good use characteristics for usual domestic usages.

The window wiper is substantially produced uniformly from a polymeric material. The pre-assemblable unit 14 denotes the combination of the wiper head 1 with the joint 4, whereas the pre-assemblable unit 15 denotes the combination of wiper handle 2 and joint 4, the provision of one or other solution depending on the respective circumstances of the case of use.

FIG. 1 shows the window wiper in the state supplied by the manufacturer or when the window wiper is applied to the very top of the window to be wiped. In this case, the offset angle is minimal and corresponds to the initial offset angle 5 between the wiper head 1 and the wiper handle 2. In the embodiment shown here, the initial offset angle 5 is approximately 135°.

When the illustrated window wiper is moved downwards on the window to be cleaned to remove the cleaning liquid from the window pane, the initial offset angle 5 becomes increasingly greater in a continuous and automatic manner until the maximum final offset angle 6 is reached.

In FIG. 2, the wiper head 1 and the wiper handle 2 define the maximum final offset angle 6 which is approximately 165° in the embodiment shown. The maximum final offset angle 6 is defined by the wiper head 1 and wiper handle 2 when the lower region of the window is wiped. Due to the increase in the offset angle, the wiper handle can be moved past a windowsill which is situated under the window to be wiped.

Furthermore, it is advantageous that due to the flexible joint 4 and the movability of wiper head 1 relative to wiper handle 2 about the flexible joint 4, the window wiper lies comfortably in the hand even when the lower region of the window is being wiped; the wrist does not have to be turned in an awkward manner.

Even better, the wiper handle of the window wiper can be guided around a windowsill when, as shown in the embodiment, the wiper handle 2 has on its side remote from the wiper head 1, a substantially flat standing surface 16 which merges in an arcuately rounded manner into the underside 17 of the wiper handle 2. Due to the rounded shape, it is even easier to prevent the wiper handle 2 from being undesirably prematurely placed on the windowsill while the lower region of the window is being wiped.

Figure 3:
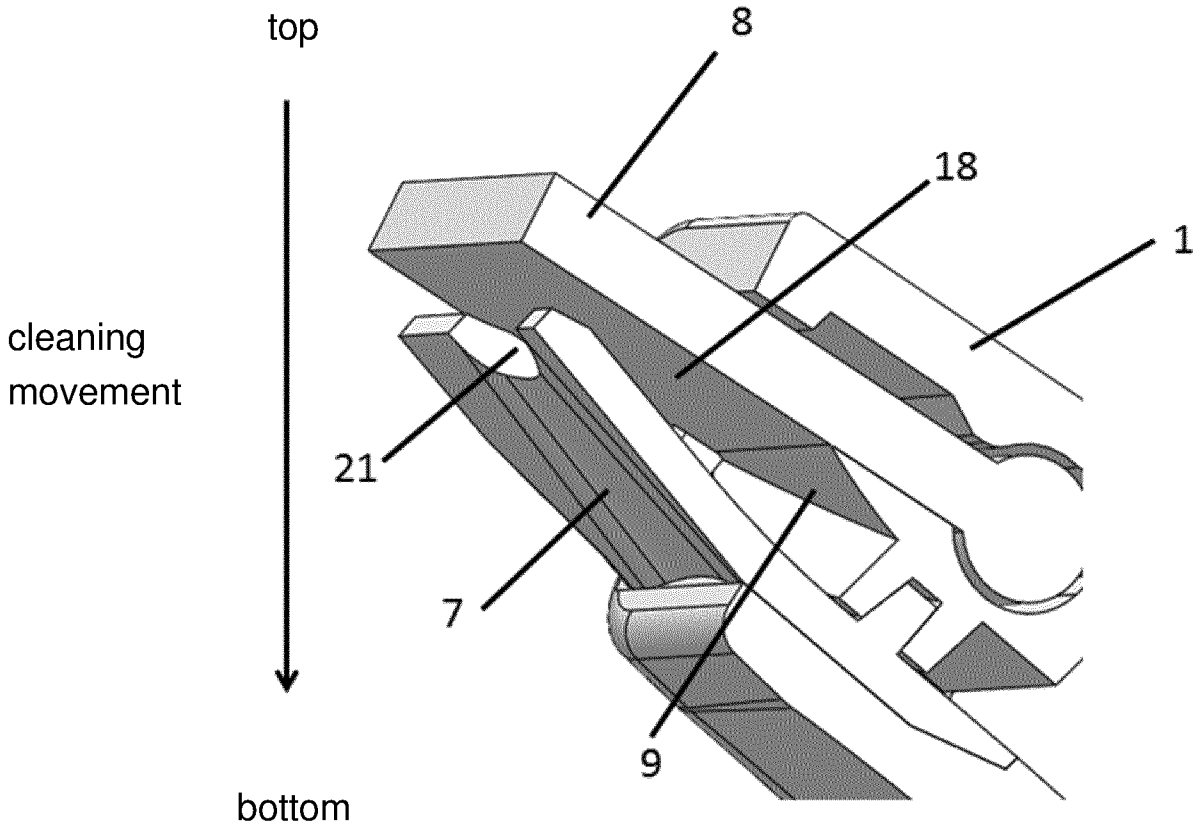
FIG. 3 shows a detail of the front part of the wiper head, with the front sealing lip in the wiping direction and the rear squeegee lip in the wiping direction which define the storage space.

FIG. 3 shows a detail of the front part of the wiper head 1, with the front sealing lip 7 in the wiping direction and the rear squeegee lip 8 in the wiping direction, which define the storage space 18. The suction nozzle 9 and the two squeegee lips 7, 8, of which the front squeegee lip 7 in the wiping direction is configured as a sealing lip, are associated with each other in a functional series connection. To wipe a window, the window wiper configured as a suction wiper is moved from the top to the bottom along the surface to be wiped. The cleaning liquid which is on the window and is to be wiped off is accumulated by contact with the front sealing lip 7 in the wiping direction, the accumulated cleaning liquid passing into the storage space 18 through openings 21 in the sealing lip 7 and is retained therein by the rear squeegee lip 8 in the wiping direction. The openings 21 are arranged in spacings next to each other along the sealing lip, they are semicircular and run into the sealing edge of the sealing lip 7.

Figure 4:
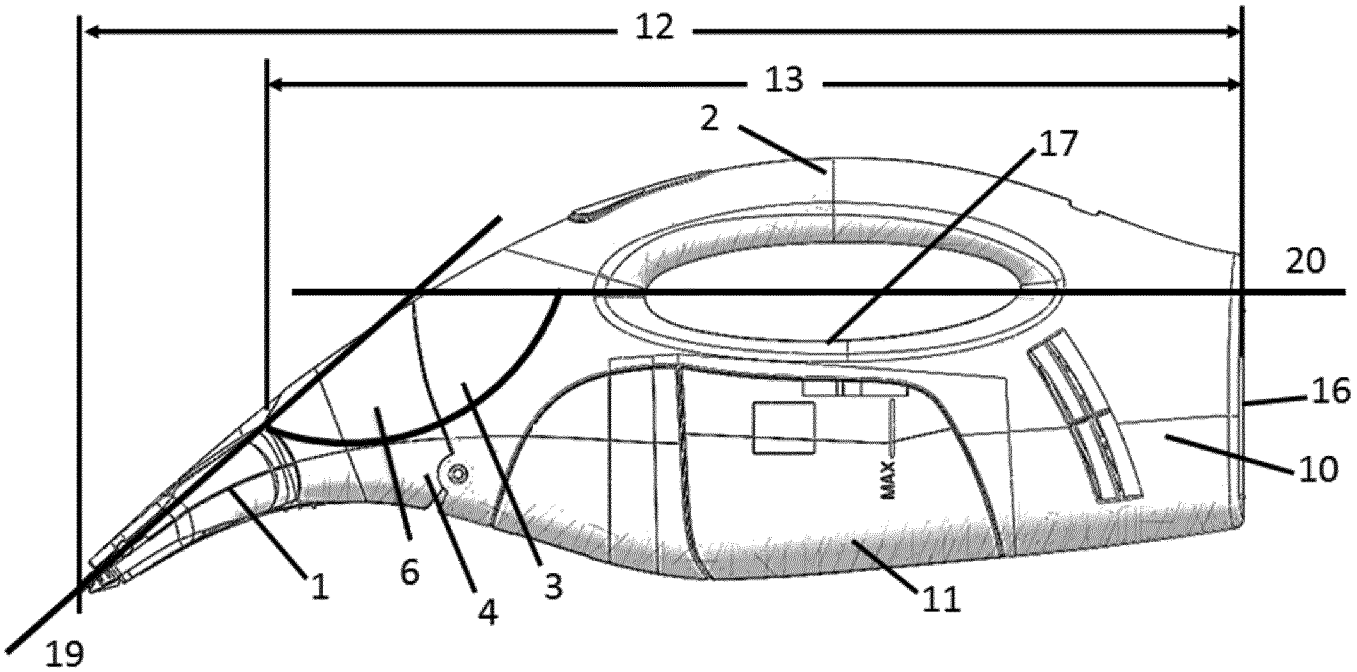
FIG. 4 is a side view of a window wiper which is configured as a window suction device, the offset angle being shown in this view.

FIG. 4 is a side view of the window wiper configured as a window suction device, the offset angle 3 being shown in this view. The offset angle denotes the angle between the main axis 19 of the squeegee lip 8 and the main axis 20 of the wiper handle 2.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A window wiper which is substantially T-shaped, the wiper comprising:

a wiper head;

a wiper handle; and a flexible joint that interconnects the wiper head and the wiper handle, wherein the wiper head is arranged offset relative to the wiper handle so as to define an offset angle between the wiper head and the wiper handle, wherein the wiper head and the wiper handle are configured to be movable from an initial offset angle into a maximum final offset angle against a spring force of the flexible joint, wherein the wiper head includes a first squeegee lip and a second squeegee lip, the first and second squeegee lips being adjacently spaced from one another and extending parallel to one another, wherein the first squeegee lip comprises a front squeegee lip in a wiping direction of the wiper, the front squeegee lip being configured as a sealing lip, wherein the second squeegee lip comprises a rear squeegee lip, wherein the front squeegee lip defines, with the rear squeegee lip in the wiping direction, a storage space, wherein the storage space is connected in a flow-conducting manner to a suction device, and wherein the first squeegee lip includes at least one opening configured to allow accumulated cleaning liquid pass into the storage space.

2. The wiper of claim 1, wherein the initial offset angle corresponds to a minimum offset angle between the wiper head and the wiper handle.

3. The wiper of claim 1, wherein the maximum final offset angle is 120° to 175°, the initial offset angle is 95° to 150°, and the initial offset angle is always less than the final offset angle.

4. The wiper of claim 1, wherein the first and second squeegee lips are disposed on a side of the wiper head remote from the wiper handle.

5. The wiper of claim 4, wherein the first and second squeegee lips include a flexible rubber material.

6. The wiper of claim 4, wherein the first and second squeegee lips consist essentially of a flexible rubber material.

7. The wiper of claim 1, wherein the wiper head includes a suction nozzle, and wherein the wiper handle includes the suction device and a dirty water tank, both of which are arranged in the wiper handle.

8. The wiper of claim 1, wherein a ratio of an overall length of the window wiper in cm to the maximum final offset angle in degrees is 0.2 to 0.4.

9. The wiper of claim 8, wherein a minimum overall length of the wiper is 25 cm.

10. The wiper of claim 1, wherein the wiper handle has a minimum length of 20 cm.

11. The wiper of claim 1, wherein the wiper head and/or the wiper handle and/or the flexible joint include a polymeric material.

12. The wiper of claim 1, wherein the wiper head and the flexible joint or the wiper handle and the joint are respectively configured as a pre-assemblable unit.

13. The wiper of claim 1, wherein the wiper handle includes, on its side remote from the wiper head, a substantially flat standing surface, the substantially flat standing surface merging into an underside of the wiper handle in an bow-shapedly rounded or beveled manner.

14. The wiper of claim 1, wherein a minimum overall length of the wiper is 25 cm.

15. The wiper of claim 1, wherein the wiper head and/or the wiper handle and/or the flexible joint consist essentially of a polymeric material.

* * * * *